US010619592B2

(12) United States Patent
Lee et al.

(10) Patent No.: US 10,619,592 B2
(45) Date of Patent: Apr. 14, 2020

(54) CYLINDER BLOCK

(71) Applicants: Hyundai Motor Company, Seoul (KR); Kia Motors Corporation, Seoul (KR)

(72) Inventors: Byung Soo Lee, Gyeonggi-do (KR); Bong Sang Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 217 days.

(21) Appl. No.: 15/837,984

(22) Filed: Dec. 11, 2017

(65) Prior Publication Data

US 2019/0112998 A1 Apr. 18, 2019

(30) Foreign Application Priority Data

Oct. 16, 2017 (KR) ..... 10-2017-0134048

(51) Int. Cl.
*F02F 1/14* (2006.01)
*F01P 3/02* (2006.01)

(52) U.S. Cl.
CPC ..... *F02F 1/14* (2013.01); *F01P 3/02* (2013.01); *F01P 2003/021* (2013.01)

(58) Field of Classification Search
CPC ..... F01P 2003/021; F01P 3/02; F02F 1/14; F02F 1/02; F02F 1/10; F02F 1/166
See application file for complete search history.

(56) References Cited

U.S. PATENT DOCUMENTS

2018/0094568 A1* 4/2018 Yanagi ..... F02F 1/14
2018/0363587 A1* 12/2018 Yoshimura ..... F02F 1/14

FOREIGN PATENT DOCUMENTS

JP 2006-233761 A 9/2006
JP 4088270 B2 5/2008
JP 4474338 B2 6/2010

* cited by examiner

*Primary Examiner* — Jacob M Amick
*Assistant Examiner* — Ruben Picon-Feliciano
(74) *Attorney, Agent, or Firm* — Mintz Levin Cohn Ferris Glovsky and Popeo, P.C.; Peter F. Corless

(57) ABSTRACT

A cylinder block includes: a plurality of cylinders; a water jacket through which a coolant flows along an outer periphery of the plurality of cylinders; and insertion members which are inserted into the water jacket formed at both sides of the plurality of cylinders in order to separately cool upper and lower portions of the plurality of cylinders, in which the insertion members restrict a flow of the coolant at a lower side of the water jacket and generate a flow of the coolant at an upper side of the water jacket.

8 Claims, 7 Drawing Sheets

CYLINDER BLOCK

CROSS-REFERENCE TO RELATED APPLICATION

This application claims under 35 U.S.C. § 119(a) the benefit of Korean Patent Application No. 10-2017-0134048 filed in the Korean Intellectual Property Office on Oct. 16, 2017, the entire contents of which are incorporated herein by reference.

BACKGROUND (a) Technical Field

The present disclosure relates to a cylinder block of a vehicle engine, more particularly to a cylinder block capable of implementing a cross flow type coolant flow by having an insertion member in a water jacket.

(b) Description of the Related Art

In general, heat generated in a combustion chamber of an engine is partially absorbed by a cylinder head, a cylinder block, intake and exhaust valves, a piston, and the like. If temperatures of these components are excessively increased, the components are thermally deformed or a defect in lubrication occurs due to damage to an oil film on an inner wall of a cylinder, and thus a thermal problem occurs.

The thermal problem of the engine causes abnormal combustion such as a combustion defect and knocking, which causes serious damage such as melting of the piston. In addition, there is a problem in that thermal efficiency and engine output may deteriorate. On the contrary, because excessive cooling of the engine causes problems of deterioration in engine output and fuel economy and low-temperature abrasion of the cylinder, it is necessary to appropriately control a temperature of the coolant.

In this aspect, a water jacket is formed in the cylinder block and the cylinder head of the engine in the related art, and the coolant, which circulates in the water jacket, cools metal surfaces at a periphery of a spark plug corresponding to a combustion chamber, an exhaust port, and a valve seat.

However, in the engine in the related art, the coolant, which is introduced in order of the cylinders, circulates in the water jacket applied to the cylinder block, and as a result, there is a problem in that cylinder blocks corresponding to upper and lower portions of the combustion chamber where there occurs a relative temperature difference cannot be effectively cooled, such that an overall effect of cooling the engine is inadequate.

In particular, the upper portion of the cylinder block, which is close to the combustion chamber, may become overheated, which causes various problems. Meanwhile, the lower portion of the cylinder block, which is comparatively distant from the combustion chamber, may be excessively cooled, which causes an increase in time required for warming-up.

The above information disclosed in this Background section is only for enhancement of understanding the background of the disclosure and therefore it may contain information that does not form the prior art that is already known in this country to a person of ordinary skill in the art.

SUMMARY

The present disclosure provides a cylinder block in which upper and lower portions of the cylinder block are separately cooled, thereby minimizing a temperature deviation between cylinders.

An exemplary embodiment of the present disclosure provides a cylinder block including: a plurality of cylinders; a water jacket through which a coolant flows along an outer periphery of the plurality of cylinders; and insertion members which are inserted into the water jacket formed at both sides of the plurality of cylinders in order to separately cool upper and lower portions of the plurality of cylinders, in which the insertion members restrict a flow of the coolant at a lower side of the water jacket and generate a flow of the coolant at an upper side of the water jacket.

The insertion members may include: a first insertion member which is inserted at one side of the water jacket; and a second insertion member which is inserted at another side of the water jacket.

The first insertion member and the second insertion member may include: frame members which include flow restricting portions that are formed at the lower side of the water jacket and have a semi-circular shape to surround bores of the plurality of cylinders; and thermal insulating members which are disposed between the plurality of cylinders and the frame members and attached to the flow restricting portions.

The frame member may include flow portions which protrude from the flow restricting portions toward the upper side of the water jacket and generate a flow of the coolant.

The flow restricting portion formed on the frame member of the first insertion member may be formed such that a height of the flow restricting portion is increased from a front side to a rear side of the frame member, and the flow restricting portion formed on the frame member of the second insertion member may be formed such that a height of the flow restricting portion is increased from the rear side to the front side of the frame member.

The thermal insulating members of the first insertion member may be formed to have sizes corresponding to heights of the flow restricting portions formed on the frame member of the first insertion member, and the thermal insulating members of the second insertion member may be formed to have sizes corresponding to heights of the flow restricting portions formed on the frame member of the second insertion member.

The thermal insulating members may be made of a rubber material and may restrict a flow of the coolant by being expanded in volume when a temperature of the coolant is increased.

A portion of the flow restricting portion, which is in contact with the cylinder block, may be formed in a lattice shape in order to minimize friction between the frame member and the cylinder block.

The first insertion member may further include a first sealing member which blocks a flow of the coolant from the one side of the water jacket to the another side of the water jacket.

The second insertion member may further include a second sealing member which blocks a flow of the coolant from the another side of the water jacket to the one side of the water jacket.

According to the present disclosure, the insertion members are disposed in the water jacket in the cylinder block, and the flow restricting portions and the thermal insulating members restrict a flow of the coolant at the lower side of the water jacket, thereby providing an environment capable of preventing overheating of the upper portion of the cylinder block by separately cooling the upper and lower portions of the cylinder block, and improving a thermal insulation performance of the lower portion of the cylinder block.

In addition, according to the present disclosure, the flow restricting portion of the frame member is formed to have a predetermined gradient, thereby providing an environment capable of increasing a flow velocity of the coolant.

In addition, according to the present disclosure, a gradient of the flow restricting portion formed at the one side of the water jacket and a gradient of the flow restricting portion formed at the another side of the water jacket are symmetric, and the coolant flows in a cross flow type, thereby providing an environment capable of minimizing a temperature deviation between the cylinders in the cylinder block.

In addition, according to the present disclosure, the portion of the flow restricting portion of the frame member, which is in contact with the cylinder block, is formed in a lattice shape, thereby providing an environment capable of minimizing friction between the frame member and the cylinder block.

DETAILED DESCRIPTION OF THE EMBODIMENTS

Figure 1:
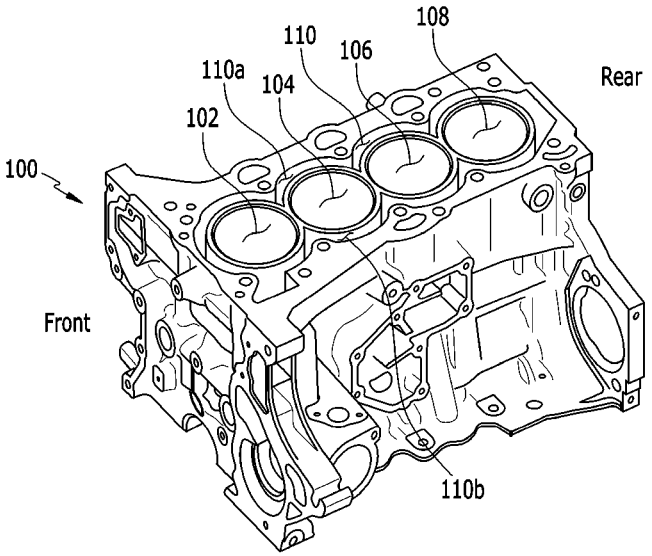
FIG. 1 is a perspective view illustrating a cylinder block according to an exemplary embodiment of the present disclosure, in which an insertion member is inserted into a water jacket.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

In the following detailed description, only certain exemplary embodiments of the present disclosure have been shown and described, simply by way of illustration. As those skilled in the art would realize, the described embodiments may be modified in various different ways, all without departing from the spirit or scope of the present disclosure.

A cylinder block according to an exemplary embodiment of the present disclosure will be described in detail with reference to FIGS. 1 to 7.

Figure 2:
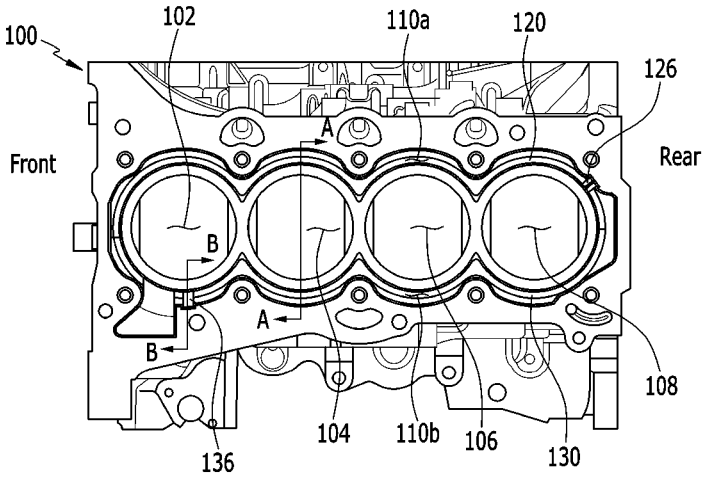
FIG. 2 is a top plan view illustrating the cylinder block of FIG. 1 when viewed from the top side.
Figure 3:
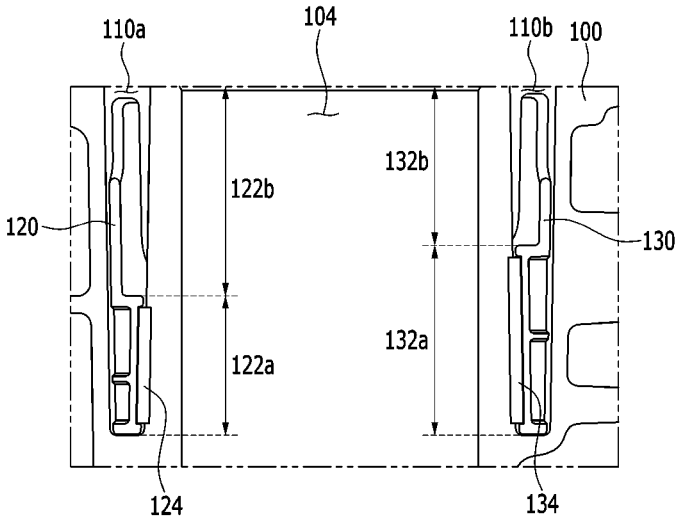
FIG. 3 is a cross-sectional view illustrating a cross section taken along line A-A of FIG. 2.
Figure 4:
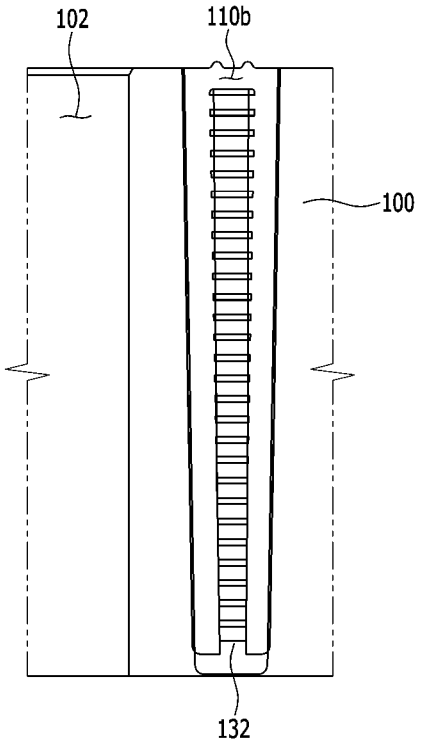
FIG. 4 is a cross-sectional view illustrating a cross section taken along line B-B of FIG. 2.

FIG. 1 is a perspective view illustrating a cylinder block according to the exemplary embodiment of the present disclosure, in which an insertion member is inserted into a water jacket, FIG. 2 is a top plan view illustrating the cylinder block of FIG. 1 when viewed from the top side, FIG. 3 is a cross-sectional view illustrating a cross section taken along line A-A of FIG. 2, and FIG. 4 is a cross-sectional view illustrating a cross section taken along line B-B of FIG. 2.

Referring to FIG. 1, in an engine including a cylinder head and a cylinder block, a cylinder block 100 according to the exemplary embodiment of the present disclosure has a plurality of cylinders 102 to 108. For example, a first cylinder 102, a second cylinder 104, a third cylinder 106, and a fourth cylinder 108 may be formed in the cylinder block 100.

A water jacket 110 through which a coolant flows along an outer periphery of the plurality of cylinders 102 to 108 is formed in the cylinder block 100.

Further, in the engine including the cylinder block 100 according to the exemplary embodiment of the present disclosure, the coolant may flow in a cross flow type such that the coolant flows upward from one side 110*a* of the water jacket in a direction toward the cylinder head (not illustrated), passes through an exhaust valve (not illustrated) side and an intake valve (not illustrated) side of the cylinder head, and then flows to the other side 110*b* of the water jacket.

Referring to FIGS. 1 and 2, insertion members 120 and 130, which are inserted into the water jacket formed at both sides of the plurality of cylinders, respectively, are disposed in the water jacket 110 in order to separately cool upper and lower portions of the plurality of cylinders 102 to 108.

The insertion members 120 and 130 may restrict a flow of the coolant at a lower side of the water jacket 110, but may generate/increase a flow of the coolant at an upper side of the water jacket 110.

As illustrated in FIG. 2, in the cylinder block 100 according to the exemplary embodiment of the present disclosure, a first insertion member 120 is disposed at one side 110*a* of the water jacket corresponding to a position of the exhaust valve (not illustrated), and a second insertion member 130 is disposed at the other side 110*b* of the water jacket corresponding to a position of the intake valve (not illustrated).

Figure 5:
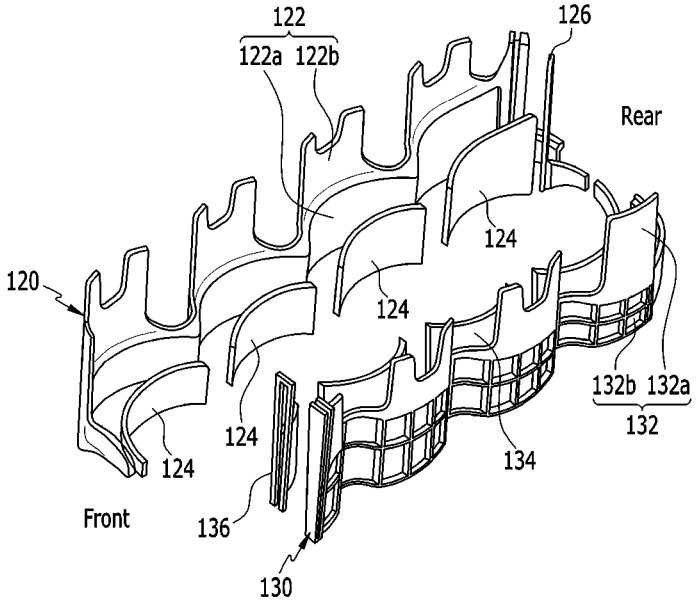
FIG. 5 is an exploded perspective view of insertion members to be inserted into the water jacket of the cylinder block according to the exemplary embodiment of the present disclosure.

FIG. 5 is an exploded perspective view of the insertion members to be inserted into the water jacket of the cylinder block according to the exemplary embodiment of the present disclosure.

Referring to FIG. 5, according to the exemplary embodiment of the present disclosure, the insertion members 120 and 130 include the first insertion member 120 inserted at one side 110*a* of the water jacket, and the second insertion member 130 inserted at the other side 110*b* of the water jacket.

According to the exemplary embodiment of the present disclosure, the first insertion member 120 includes a first frame member 122, first thermal insulating members 124, and a first sealing member 126. Further, according to the exemplary embodiment of the present disclosure, the second insertion member 130 includes a second frame member 132, second thermal insulating members 134, and a second sealing member 136.

According to the exemplary embodiment of the present disclosure, the frame members 122 and 132 may be made of a plastic material. Further, according to the exemplary embodiment of the present disclosure, the frame members 122 and 132 include flow restricting portions 122*a* and 132*a* and flow portions 122*b* and 132*b*.

The flow restricting portions 122*a* and 132*a* are formed at a lower side of the water jacket 110, and have a semi-circular shape in order to surround bores of the plurality of cylinders. Further, the flow restricting portions 122*a* and 132*a* may be formed to have a predetermined gradient from one side to the other side of the frame members 122 and 132.

Further, the flow portions 122*b* and 132*b* protrude from the flow restricting portions 122*a* and 132*a* toward an upper side of the water jacket 110, and may generate a flow of the coolant in the water jacket.

The thermal insulating members 124 and 134 are disposed between the plurality of cylinders 102 to 108 and the frame members 122 and 132, and may be attached to the flow restricting portions 122*a* and 132*a*.

According to the exemplary embodiment of the present disclosure, the thermal insulating members 124 and 134 are made of a rubber material, and restrict a flow of the coolant by being expanded in volume when a temperature of the coolant is increased. The thermal insulating members 124 and 134 may be made of a material having a higher coefficient of thermal expansion than the cylinder block made of aluminum. The thermal insulating members 124 and 134 come into close contact with bore surfaces of the cylinders by the volume expansion, and the close contact state may be continuously maintained.

The sealing members 126 and 136 block a flow of the coolant between one side 110*a* of the water jacket and the other side 110*b* of the water jacket. For example, the first sealing member 126 may block a flow of the coolant from one side 110*a* of the water jacket to the other side 110*b* of the water jacket, and the second sealing member 136 may block a flow of the coolant from the other side 110*b* of the water jacket to one side 110*a* of the water jacket.

Figure 6:
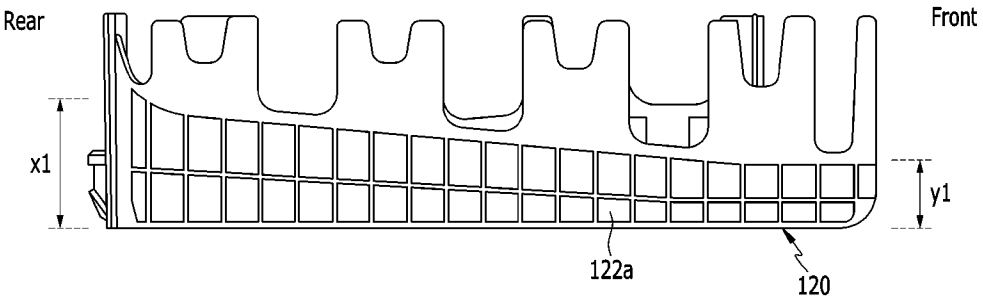
FIG. 6 is a side view illustrating the insertion members of FIG. 5 when viewed from a first insertion member.
Figure 7:
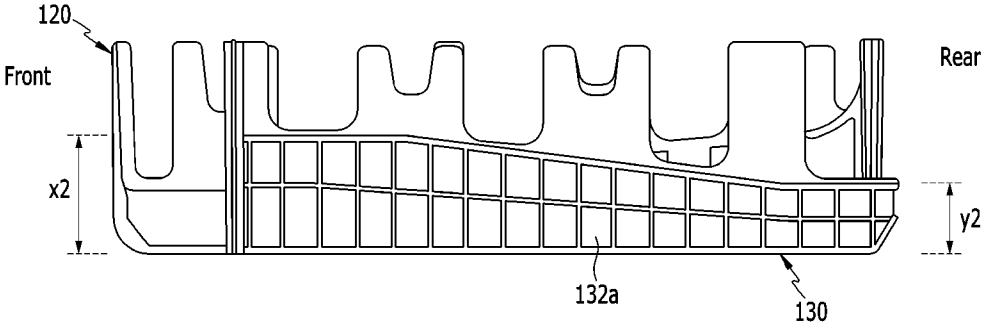
FIG. 7 is a side view illustrating the insertion members of FIG. 5 when viewed from a second insertion member.

FIG. 6 is a side view illustrating the insertion members of FIG. 5 when viewed from a first insertion member, and FIG. 7 is a side view illustrating the insertion members of FIG. 5 when viewed from a second insertion member.

Referring to FIG. 6, the first flow restricting portion 122*a* formed on the first frame member 122 of the first insertion member 120 is formed such that a height of the first flow restricting portion 122*a* is increased from one side (front side) to the other side (rear side) of the first frame member 122. For example, a height x1 of the first flow restricting portion 122*a* at the other side (rear side) of the first frame member 122 may be greater than a height y1 of the first flow restricting portion 122*a* at one side (front side) of the first frame member 122. Further, the first thermal insulating member 124 of the first insertion member 120 may be formed to have a size corresponding to the height of the first flow restricting portion 122*a*.

Referring to FIG. 7, the second flow restricting portion 132*a* formed on the second frame member 132 of the second insertion member 130 is formed such that a height of the second flow restricting portion 132*a* is increased from the other side (rear side) to one side (front side) of the second frame member 132. For example, a height x2 of the second flow restricting portion 132*a* at one side (front side) of the first frame member 122 may be greater than a height y2 of the second flow restricting portion 132*a* at the other side (rear side) of the first frame member 122. In addition, the second thermal insulating member 134 of the second insertion member 130 may be formed to have a size corresponding to a height of the second flow restricting portion 132*a*.

Further, portions of the flow restricting portions 122*a* and 132*a*, which are in contact with the cylinder block, may be formed in a lattice shape in order to minimize friction between the frame members and the cylinder block.

As described above, in the cylinder block according to the exemplary embodiment of the present disclosure, the insertion members are inserted into the water jacket in the cylinder block, and the flow restricting portions and the thermal insulating members restrict a flow of the coolant at the lower side of the water jacket, thereby providing an environment capable of preventing overheating of the upper portion of the cylinder block by separately cooling the upper and lower portions of the cylinder block, and improving a thermal insulation performance of the lower portion of the cylinder block.

In addition, in the cylinder block according to the exemplary embodiment of the present disclosure, the flow restricting portion of the frame member is formed to have a predetermined gradient, thereby providing an environment capable of increasing a flow velocity of the coolant.

In addition, in the cylinder block according to the exemplary embodiment of the present disclosure, a gradient of the flow restricting portion formed at one side of the water jacket and a gradient of the flow restricting portion formed at the other side of the water jacket are symmetric, and the coolant flows in a cross flow type, thereby providing an environment capable of minimizing a temperature deviation between the cylinders in the cylinder block.

In addition, in the cylinder block according to the exemplary embodiment of the present disclosure, the portion of the flow restricting portion of the frame member, which is in contact with the cylinder block, is formed in a lattice shape, thereby providing an environment capable of minimizing friction between the frame member and the cylinder block.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. A cylinder block, comprising:

a plurality of cylinders;

a water jacket through which a coolant flows along an outer periphery of the plurality of cylinders; and insertion members which are inserted into the water jacket formed at both sides of the plurality of cylinders in order to separately cool upper and lower portions of the plurality of cylinders, wherein the insertion members restrict a flow of the coolant at a lower side of the water jacket and generate a flow of the coolant at an upper side of the water jacket, wherein the insertion members include:

a first insertion member which is inserted at one side of the water jacket;

a second insertion member which is inserted at another side of the water jacket; and frame members which include flow restricting portions that are formed at the lower side of the water jacket and have a semi-circular shape to surround bores of the plurality of cylinders, wherein the flow restricting portion formed on the frame member of the first insertion member is formed such that a height of the flow restricting portion is increased from a front side to a rear side of the frame member, and wherein the flow restricting portion formed on the frame member of the second insertion member is formed such that a height of the flow restricting portion is increased from the rear side to the front side of the frame member.

2. The cylinder block of claim 1, wherein the first insertion member and the second insertion member include:

thermal insulating members which are disposed between the plurality of cylinders and the frame members and attached to the flow restricting portions.

3. The cylinder block of claim 2, wherein the frame member includes:

flow portions which protrude from the flow restricting portions toward the upper side of the water jacket and generate a flow of the coolant.

4. The cylinder block of claim 2, wherein:

the thermal insulating members of the first insertion member are formed to have sizes corresponding to heights of the flow restricting portions formed on the frame member of the first insertion member, and the thermal insulating members of the second insertion member are formed to have sizes corresponding to heights of the flow restricting portions formed on the frame member of the second insertion member.

5. The cylinder block of claim 2, wherein:

the thermal insulating members are made of a rubber material and restrict a flow of the coolant by being expanded in volume when a temperature of the coolant is increased.

6. The cylinder block of claim 2, wherein:

a portion of the flow restricting portion, which is in contact with the cylinder block, is formed in a lattice shape in order to minimize friction between the frame member and the cylinder block.

7. The cylinder block of claim 2, wherein:

the first insertion member further includes a first sealing member which blocks a flow of the coolant from the one side of the water jacket to the another side of the water jacket.

8. The cylinder block of claim 2, wherein:

the second insertion member further includes a second sealing member which blocks a flow of the coolant from the another side of the water jacket to the one side of the water jacket.

* * * * *